United States Patent [19]

Teglund et al.

[11] 4,190,910

[45] Mar. 4, 1980

[54] PLUMBING APPARATUS INCLUDING MEANS FOR PRODUCING A WATER-PLUG EFFECT IN SANITATION APPLIANCES

[75] Inventors: Lars Teglund; Melchiorre Oldani, both of Gustavsberg, Sweden

[73] Assignee: AB Gustavsberg, Gustavsberg, Sweden

[21] Appl. No.: 882,180

[22] Filed: Feb. 28, 1978

[30] Foreign Application Priority Data

Mar. 2, 1977 [SE] Sweden ..... 7702341

[51] Int. Cl.[2] ..... E03D 11/02; E03D 11/18

[52] U.S. Cl. ..... 4/421; 4/426; 4/415; 137/403; 137/409

[58] Field of Search ..... 4/1, 286, 420, 295, 4/421, 415, 426; 137/403, 409

[56] References Cited

U.S. PATENT DOCUMENTS

| | | | |
|---|---|---|---|
| 2,638,178 | 5/1953 | McRill | 137/409 |
| 3,838,706 | 10/1974 | Klenk et al. | 137/403 |

*Primary Examiner*—Henry K. Artis

*Attorney, Agent, or Firm*—Toren, McGeady and Stanger

[57] ABSTRACT

A sanitation appliance such as a water-closet or the like equipped with a generally vertically extending outlet pipe is provided with a resilient diaphragm mounted within said pipe and extending thereacross to stem the flow of flushing water passing through said pipe until a sufficient quantity of the water has accumulated whereupon the diaphragm operates to pass the water through the pipe thereby to cause the accumulated water to act as a water plug creating a suction effect within the pipe.

4 Claims, 6 Drawing Figures

PLUMBING APPARATUS INCLUDING MEANS FOR PRODUCING A WATER-PLUG EFFECT IN SANITATION APPLIANCES

BACKGROUND OF THE INVENTION

The present invention relates generally to plumbing apparatus, and more particularly, to sanitary appliances such as water-closets and the like. The invention is directed to the provision of means to be fitted to the outlet pipe of a water-closet or like appliance, such as a urinal, by means of which the flushing action of the appliance may be enhanced and improved.

Flushing of water-closets uses considerable quantities of water, which is usually drawn from supplies of generally drinkable quality. In an average household a water-closet may be flushed 12–16 times for each twenty-four hour period. Moreover, members of a given household will ordinarily use water-closets away from the home, such as in an office or factory.

Most closets require 9 liters of water or more for each flushing, such a quantity of water being considered necessary for displacement of waste matter from a water-closet pan through the discharge pipe. The term "waste matter" is meant to include all kinds of non-fluid refuse, having a density of about 1.0, which are normally removed by way of water-closets from residential houses and other premises. Not only faeces and toilet paper, but also baby napkins, paper towels, sanitary towels, rags and other refuse materials are flushed down water-closets as waste matter.

Studies of the displacement of waste matter through nearly horizontal discharge pipes have led to the observation that such pipes are almost never filled to more than 50%. As a result, some authorities taking into account regulations for the fall of such pipes, have decided to allow a flush water volume of 6 liters for water-closets. This involves closets connected to municipal sewage disposal systems wherein the pipes can have a fall of down to 3%. To make such pipes self-cleaning, the rate of flow therethrough must be a minimum of 0.6 m/second at a continuous flow.

In more rural or less populated areas, cesspools may be utilized for waste disposal in place of hook-ups to municipal water supply. In such areas, the degree of fresh water consumption of the closets is not the main problem. However, it is more important to reduce the quantity of soil water which has to be collected in a cesspool, removed by a suction pump on a container lorry and then taken to the municipal sewage treatment plant.

Some known water-closets are simply flushed with water by means of sub-atmospheric pressure in the discharge pipe without using an air stream as an aid to displacement of the waste matter. Such washdown closets may work with flush water quantities of only about 3 liters and, with such low amounts of flush water, discharge pipes with a somewhat smaller diameter are used, viz. 75 mm instead of 100 mm in conventional discharge systems. The consequence is that the displacement capacity of such a system is low, which means that the distance between the closet and the cesspool has to be restricted, in general to less than 20 m, even if the fall of the pipe is considerable.

One way of improving the flushing of a water-closet, so as to prevent part of the waste matter from remaining in the trap and requiring the user to flush a second time, is to produce a water-plug in the discharge pipe. A water-plug is the type of device which moves down a pipe and as it does so it produces behind it a sub-atmospheric pressure which sucks the remaining water and waste matter out of the trap. In water-closets utilizing a water plug, there may need to be provided means for supplementary filling of the trap in order to make up the water-seal. This may be accomplished, for example, by a branch pipe from the water-supply pipe of the water-closet cistern.

The present invention is intended to provide simple means whereby practically any water-closet with a so-called S-trap can be made to operate with a low volume flush thereby to reduce water consumption. Preferably with such means it should be possible to lead the discharge pipe in any horizontal direction and the means should be easily installed within the dimensions available with floor beams as now used.

SUMMARY OF THE INVENTION

Briefly, the present invention provides means for producing a water-plug to improve flushing of a water-closet, or like sanitary appliance, comprising a resilient diaphragm secured to the outlet pipe of the closet so as to stem the flow of flushing water through the outlet pipe until a sufficient quantity of water has accumulated to open the diaphragm and then pass into the discharge pipe as a water-plug.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1:
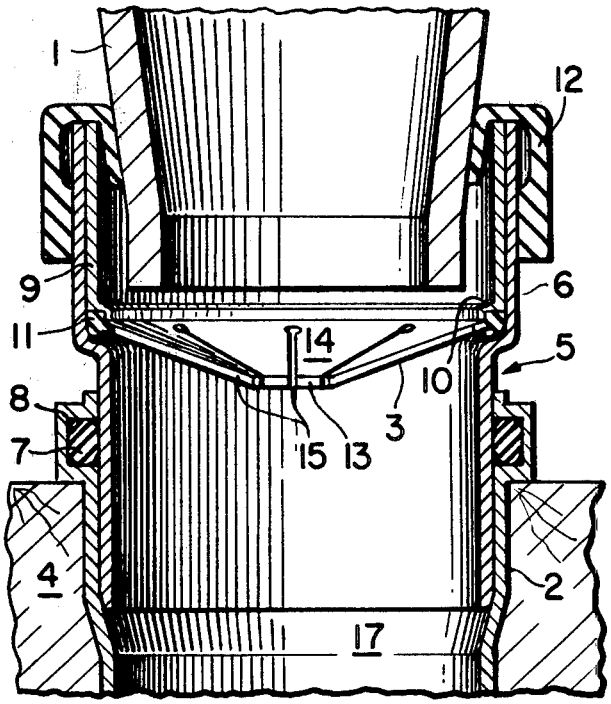
FIG. 1 is a fragmentary axial section, taken on the line I—I of FIG. 2, showing part of the outlet pipe of a water-closet, with diaphragm means in accordance with one embodiment of the invention connected between the outlet pipe and a discharge pipe.

In FIG. 1 there is shown the downward vertical end of an outlet pipe 1 extending from the S-trap of a water-closet (not shown) and connected to the entrance socket 2 of a discharge pipe. A diaphragm 3, of rubber or like resilient material, is interposed between the pipe 1 and the socket 2. The socket 2 is usually cast or otherwise set in a floor beam 4 so that only a small part of the socket projects above the floor surface. In order to accommodate variation in height between the socket 2 and outlet pipe 1, a connecting pipe 5 having a socket end 6 is interposed and sealed in the socket 2 by means of an O-ring 7 located within a grooved shoulder 8.

The diaphragm 3 is seated in the base of the socket 6 and held in place by a cylindrical telescopic expansion joint liner 9 which has an inner circumferential flange 10 bearing on an outer peripheral bead 11 of the diaphragm 3. By vertical adjustment of the connecting pipe 5 and liner 9, the diaphragm 3 is located slightly below the exit from the outlet pipe. When the closet is flushed, pressure variation occurs in the socket 6. In order to prevent the escape of undesireable odors into the toilet room, the connection between the outlet pipe 1 and the socket 6 is made gas-tight by means of a U-shaped sealing ring 12 which has sealing contact against the outsides of the outlet pipe 1 and the socket 6. The lower part of the sealing ring tends to turn upwards to maintain sealing contact of the ring against the pipe and socket.

Referring to the operation of the diaphragm of the invention, when the closet is flushed, water rushes over the inner surfaces of the pan and down into the trap where it starts to displace a large part of the water standing there, thereby bringing the waste matter into motion. The water initially displaced flows mainly down the wall of the outlet pipe 1 to the diaphragm 3 which stems the flow until a substantial quantity of water has accumulated above the diaphragm. While this is taking place, part of the water runs through a central hole 13 in the diaphragm 3 and out into the discharge pipe 2. A volume of air corresponding to the lost water volume simultaneously passes back through the hole 13. The diaphragm 3 is divided by radial slits 15 into a number of flaps 14, which are bent down as soon as the weight of the accumulated water is sufficient. When the diaphragm flaps give way, the accumulated water moves, in the form of a plug, down through the connecting pipe 5 into the discharge pipe in which there is produced, behind the plug, a sub-atmospheric pressure which propagates through the hole 13 up to the waterseal in the trap from which the remaining water is sucked out together with the waste matter. After this evacuation there remains only a small amount of flush water which runs down the sides of the pan into the trap. In order to obtain a sufficient water depth to form a waterseal in the trap (in most countries the standard depth is 50 mm) the closet can be provided with a known device for supplementary filling, such as by a branch pipe from the water-closet cistern.

Figure 3:
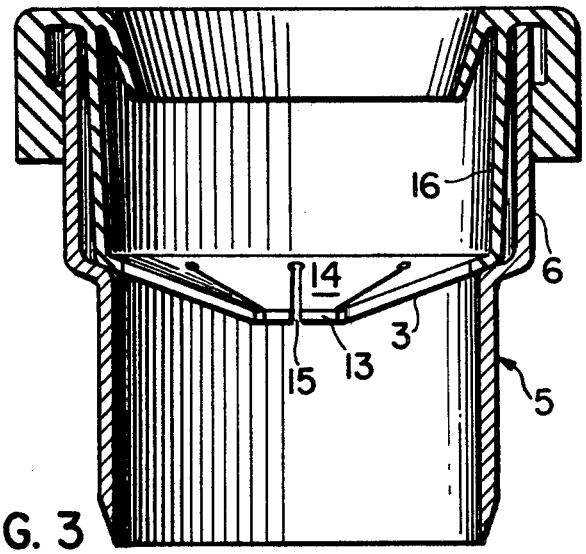
FIG. 3 shows a axial section another embodiment of the invention.

FIG. 3 shows another embodiment of the invention in which the diaphragm 3 is combined with the sealing ring 12 by an integral connecting skirt 16 which may be tubular or comprise a number of vertical suspension strips. In a modified embodiment (not shown) the diaphragm can be suspended around only about half its periphery.

Figure 4:
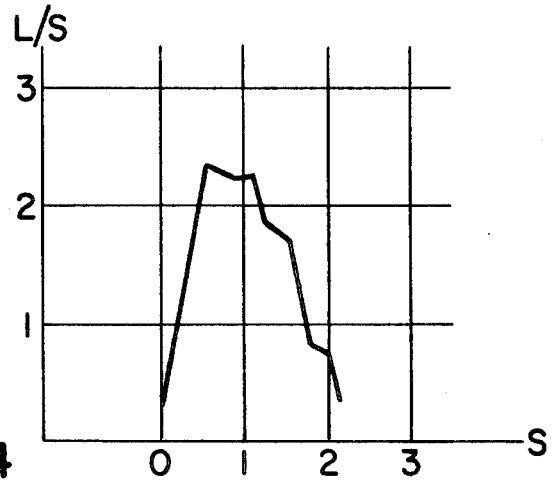
FIGS. 4, 5 and 6 are flow diagrams for low volume flush closets.
Figure 5:
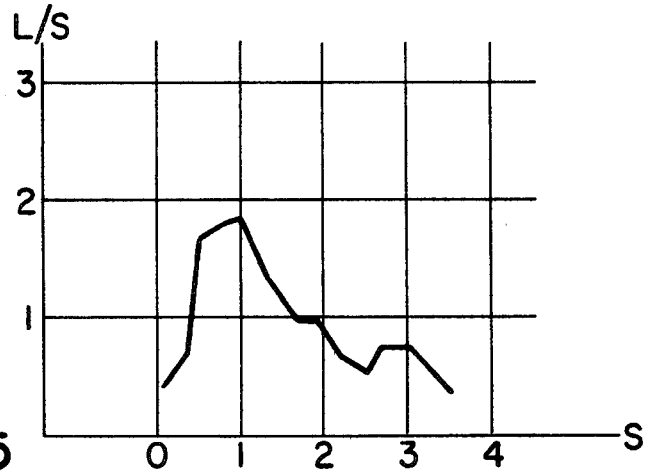
Figure 6:
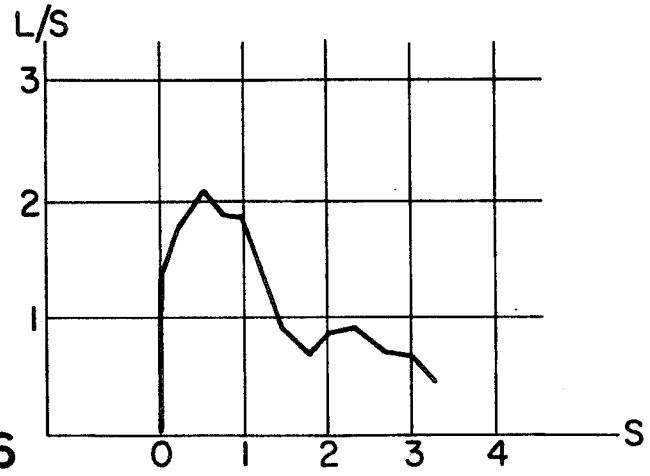

In order to illustrate the results achieved by using the present invention, FIGS. 4, 5 and 6 show flow diagrams measured at the exit from the connecting pipe 5 in the discharge pipe 17. The diagrams give the flow in liters/-second (L/S) at successive intervals of time in seconds (S) after the flush water first leaves the connecting pipe 5.

FIG. 4 shows the flow achieved when a closet without a diaphragm is flushed with 3 liters of water, recordings having been made at intervals of 0.25 seconds. From FIG. 4 it can be seen that the flow increases in 0.5 sec. to a maximum value of 2.3 L/S, which is maintained for about 0.5 sec. , and then in 1 sec. the flow decreases almost to zero.

FIG. 5 is a diagram showing flow after a diaphragm according to the invention has been installed and the quantity of flush-water has been increased by about 10%. It can be seen that the flow increases rapidly during 0.5 sec., then less rapidly to a maximum of 1.8 L/S, which is reached after 1.0 sec., decreases during 1.5 sec., increases anew during 0.5 sec., and finally dies away.

The diagram of FIG. 6 was made under the same conditions as that of FIG. 5 but with the quantity of flush water further increased by 10%. From the diagram it is clear that there has built-up a water-plug, which leaves the connecting pipe 5 with an immediate flow rate of 1.4 L/S. Within 0.5 sec. later flow has reached a maximum of around 2 L/S, which is maintained for 0.5 sec. with a reduction of only 10%, and then the flow goes down to a minimum in 0.75 sec. followed by an increase of flow during slightly more than 1 sec. This increase of flow consists of water with remaining waste matter which the water-plug sucks out of the closet trap.

Figure 2:
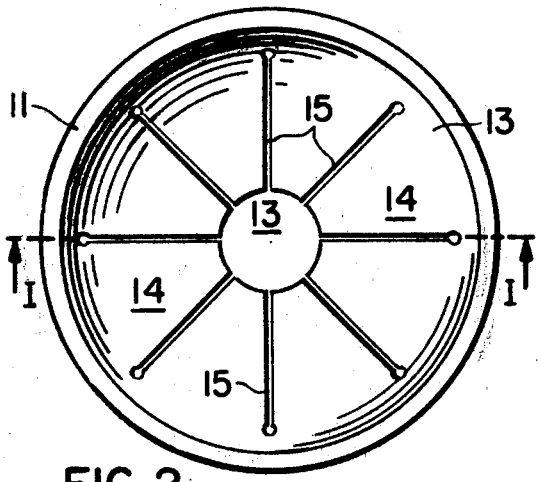
FIG. 2 is a plan view of the diaphragm of FIG. 1.

As an example, the following particulars are given of a diaphragm as shown in FIGS. 1 and 2, to give results as shown by FIGS. 5 and 6:

Material—Unreinforced natural rubber of 2 mm thickness, with a bead of 5 mm thickness.

Outer diameter—100 mm

Central hole—20 mm diameter

Conical angle—30°

Slits—8 in number, each of 25 mm radial length and width less than 1 mm.

With regard to the conditions to be achieved in the discharge system to which the closet is connected, a flushing sequence according to FIG. 6 is the most advantageous. In order to agitate waste matter from earlier flushings lying on the bottom of a nearly horizontal section of a discharge pipe and prevent it from blocking up the pipe, a flush water flow of about 2 L/S is required. The standards of some countries stipulate 2.0 L/S–10%, which is in practice fully satisfactory. A duration of 0.5 sec. for this flow is sufficient and, owing to the low hydrodynamic friction inside a discharge pipe, a flow of 0.5 L/S is sufficient to keep waste matter moving. The velocity of this motion is equivalent to that of the flush water so that a flow rate as shown by the second peak in FIG. 6 can transport waste matter through a discharge pipe of considerable length.

In summary, it will be found that flushings with flow rates as shown by the diagrams of FIGS. 4 to 6 will satisfactorily clean water-closets, although a flushing according to FIG. 4 cannot transport waste matter more than a limited distance through a discharge pipe.

The flow diagram of FIG. 5 represents flushings suitable for discharge pipes of considerable length and the diagram of FIG. 6 shows a flush flow which gives a sufficient margin for flushing through very long discharge pipes.

The form of diaphragm having a central hole and radial slits as illustrated is the preferred form of the invention. Other forms are however possible, for example a diaphragm which is secured around only part of its periphery and can thereby yield under an accumulated weight of water. Such a modified form could comprise, in an embodiment similar to that of FIG. 3, a diaphragm-supporting skirt 16 consisting of a number of vertical suspension strips as mentioned above.

Although the invention has been described as applied to a water-closet, it can, as above mentioned, also be utilized for other sanitary appliances, e.g. urinals, to improve the function of discharge systems connected to watersealed apparatus.

What is claimed is:

1. Plumbing apparatus for producing a water-plug effect during the flushing of sanitation appliances comprising outlet pipe means extending in a substantially vertical direction, said outlet pipe means constituting the flow outlet for such sanitation appliance, and resilient diaphragm means mounted to extend across said pipe means and structured to stem the flow of flushing water flowing therethrough until a sufficient quantity of water has accumulated, said diaphragm means upon accumulation of such sufficient quantity operating to pass said water through said pipe means thereby to cause said accumulated water to act as a water-plug, said resilient diaphragm means comprising a diaphragm formed from resilient material having formed therein a central opening with slits extending radially outwardly from said central opening of said diaphragm material, said slits operating to divide said diaphragm into a plurality of radially arranged flaps surrounding said central opening.

2. Apparatus according to claim 1 wherein said diaphragm is made of rubber.

3. Apparatus according to claim 1 wherein said diaphragm is formed with an outer peripheral bead extending about the outer periphery thereof, said bead operating to mount said diaphragm within said outlet pipe means, said outlet pipe means including an outlet pipe of said sanitation appliance and a connecting pipe having a socket end, said diaphragm being interposed between said outlet pipe of said sanitation appliance and said socket end of said connecting pipe.

4. Apparatus according to claim 1 wherein said outlet pipe means include a water-closet outlet pipe, a connecting pipe arranged in flow connection therewith, a sealing ring for sealing the joint between said water-closet outlet pipe and said connecting pipe, said diaphragm being combined with said sealing ring by an integral connecting skirt.

* * * * *